US005389888A

United States Patent [19]

Urano et al.

[11] Patent Number: 5,389,888

[45] Date of Patent: Feb. 14, 1995

[54] SYNCHROTRON RADIATION BEAM GENERATOR

[75] Inventors: Chiaki Urano, Narashino; Hiroyuki Suda, Narashino, both of Japan

[73] Assignee: Seiko Seiki Kabushika Kaisha, Japan

[21] Appl. No.: 898,511

[22] Filed: Jun. 15, 1992

[30] Foreign Application Priority Data

Jun. 18, 1991 [JP] Japan ..... 3-146083

[51] Int. Cl.[6] ..... H05H 13/04

[52] U.S. Cl. ..... 315/503; 313/361.1; 315/5.42

[58] Field of Search ..... 328/235, 229, 234, 236, 328/237, 238; 313/361.1, 362.1, 62; 315/5.42

[56] References Cited

U.S. PATENT DOCUMENTS 4,712,074 12/1987 Harvey ..... 328/235 X 4,996,700 2/1991 Yamashita et al. ..... 328/235 X

FOREIGN PATENT DOCUMENTS 0156200 6/1990 Japan .

*Primary Examiner*—Michael Horabik

*Assistant Examiner*—Ashok Patel

*Attorney, Agent, or Firm*—Bruce L. Adams; Van C. Wilks

[57] ABSTRACT

A radiation generator extracts a synchrotron radiation beam from an electron storing ring, through a high-vacuum atmosphere in a beam duct, while preventing loss of the high-level vacuum. A multistage axial-flow arrangement is interposed in the beam duct. Stators and rotors having a plurality of blades are alternately disposed along the axial flow arrangement. The tilt angle of some of the blades of each stator is variable. Loss of the high-level vacuum in the electron storing ring is prevented by tilting the blades having a variable tilt angle so that gas remaining in the rest of the system does not flow upstream to the high-vacuum side of the beam duct at times when the radiation beam is not passing through the beam duct.

11 Claims, 6 Drawing Sheets

SYNCHROTRON RADIATION BEAM GENERATOR

BACKGROUND OF THE INVENTION

The present invention relates to a radiation generator used as a source for generating a synchrotron radiation beam.

Synchrotron radiation beam (hereafter referred to as "radiation beam") technology has recently attracted attention, especially its possible application to the lithograph and semiconductor-processing techniques. However, the radiation beam is produced in a high vacuum atmosphere of at least approx $10^{-10}$ Torr. Therefore, to apply the beam to various techniques, it is necessary to extract a radiation beam without lowering the vacuum level of the atmosphere. This type of generator is disclosed, for example, in the Japanese Patent Laid-Open, No. 156200/1990 which corresponds to U.S. Pat. No. 4,996,700. This radiation generator has a multistage axial-flow turbine arrangement in which a plurality of stator blades and a plurality of rotor blades are alternately arranged in the axial direction. These are interposed in a beam duct disposed for extracting a radiation beam from an electron storing ring so that the radiation beam passes through the multistage axial-flow arrangement when the beam aperture 164, a "hole" formed in the blade 163 of the stator 161 shown in FIG. 9, and the gap 166 between blades 165 of the rotor 162 shown in FIG. 10 are aligned. Therefore, it is possible to extract a radiation beam regardless of its wavelength and go provide an easy-to-use radiation generator with a short beam duct.

However, this radiation generator has a problem, It is impossible to efficiently extract a radiation beam from a high vacuum atmosphere because the beam aperture 164 in the blades 163 of the stator 161 is always open and thereby, the compression ratio of the multistage axial-flow arrangement is decreased because residual gas flows backward through the beam aperature 164. Thus, it is difficult to keep the electron storing ring side at a high vacuum level.

SUMMARY OF THE INVENTION

It is an object of the present invention to provide a radiation generator for efficiently extracting a radiation beam from a high vacuum atmosphere.

To achieve the above object, the radiation generator of the present invention has a multistage axial-flow arrangement in which a stator and a rotor have a plurality of blades, respectively. The stator and rotor are alternately arranged in the axial direction in the middle of a beam duct disposed for extracting a radiation beam from an electron storing ring. The tilt angle of some of the blades of the stator is varied, so that the direction of the tilt of these blades coincides with the axial direction when the radiation beam passes through the multistage axial-flow arrangement, and these blades are greatly tilted from the axial direction when the radiation beam does not pass through the arrangement.

DETAILED DESCRIPTION OF THE PREFERRED EMBODIMENTS

An embodiment of the present invention is described below by referring to the accompanying drawings. FIGS. 1 through 7 show a first embodiment of the synchrotron radiation beam generator of the present invention.

Figure 1:
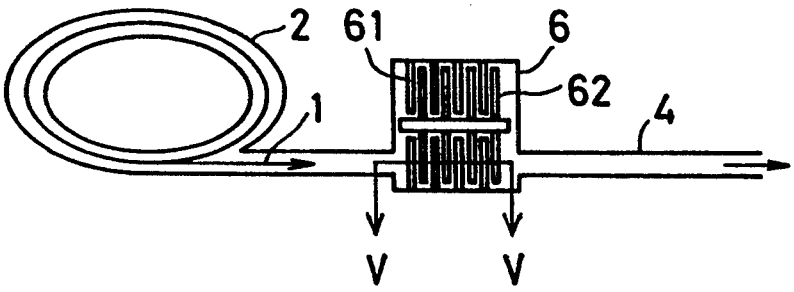
FIG. 1 is a schematic diagram of a synchrotron radiation beam generator in accordance with the present invention.

In FIG. 1, the multistage axial-flow arrangement 6 of the synchrotron radiation beam generator in accordance with the present invention is set in the middle of the beam duct 4 that is disposed for extracting radiation beam 1 out of the electron storing ring 2*a*, plurality of stators 61 and a plurality of rotors 62 are alternately arranged in the axial direction in the multistage axial-flow arrangement 6, and each center of a plurality of rotors 62 is secured to the same rotary shaft.

Figure 2A:
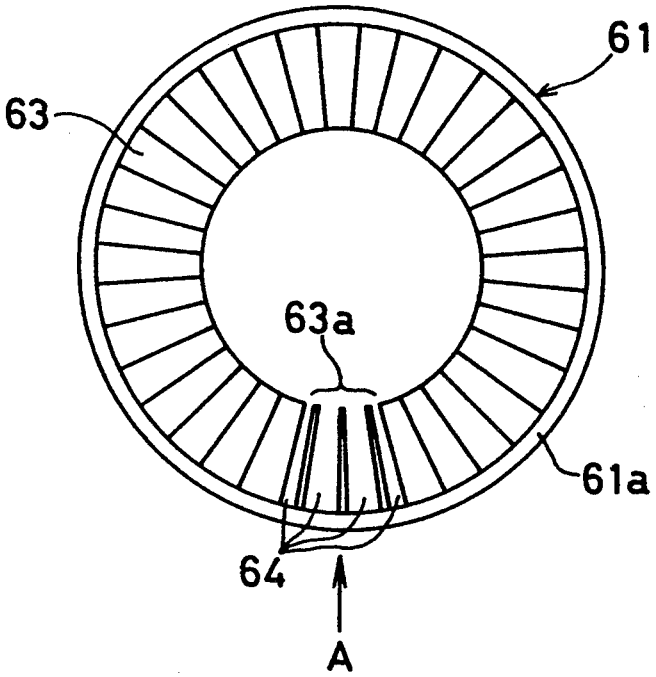
FIG. 2A is an axial view of a stator of a multistage axial-flow arrangement.
Figure 2B:
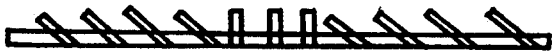
FIG. 2B is a schematic side view of a stator of a multistage axial-flow arrangement.
Figure 3:
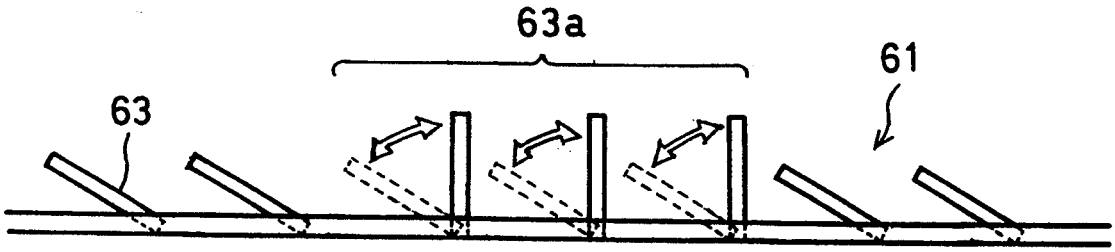
FIG. 3 is a schematic diagram of blades of the stator viewed from the direction indicated at A in FIGS. 2 and 8.

Each blade 63 of the stator 61 shown in FIGS. 2A and 2B is secured at an inclination similar to the prior art, at the both ends, as shown, in FIG. 3. However, some blades 63*a* at the bottom of the stator 61 shown in FIG. 2A are either tilted at the same inclination as that of other blades, as shown by a broken, or their direction coincides with the axial direction (the vertical direction in FIG. 3), as shown at the central part of in FIG. 3 in the solid outline. Therefore, they can rotate so that they form an opening 64 when viewed from the axial direction shown in FIG. 2A.

Figure 4A:
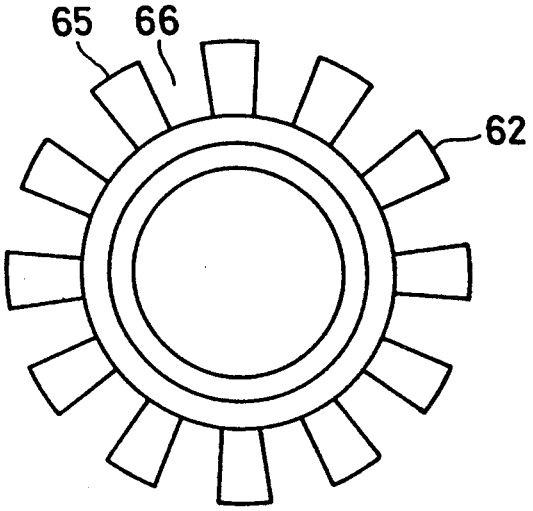
FIG. 4A is an axial view of a rotor of a multistage axial-flow arrangement.
Figure 4B:
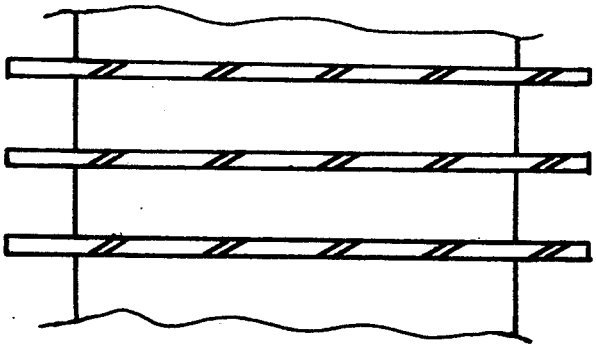
FIG. 4B is a schematic side view of a section of a rotor of a multistage axial-flow arrangement.
Figure 5:
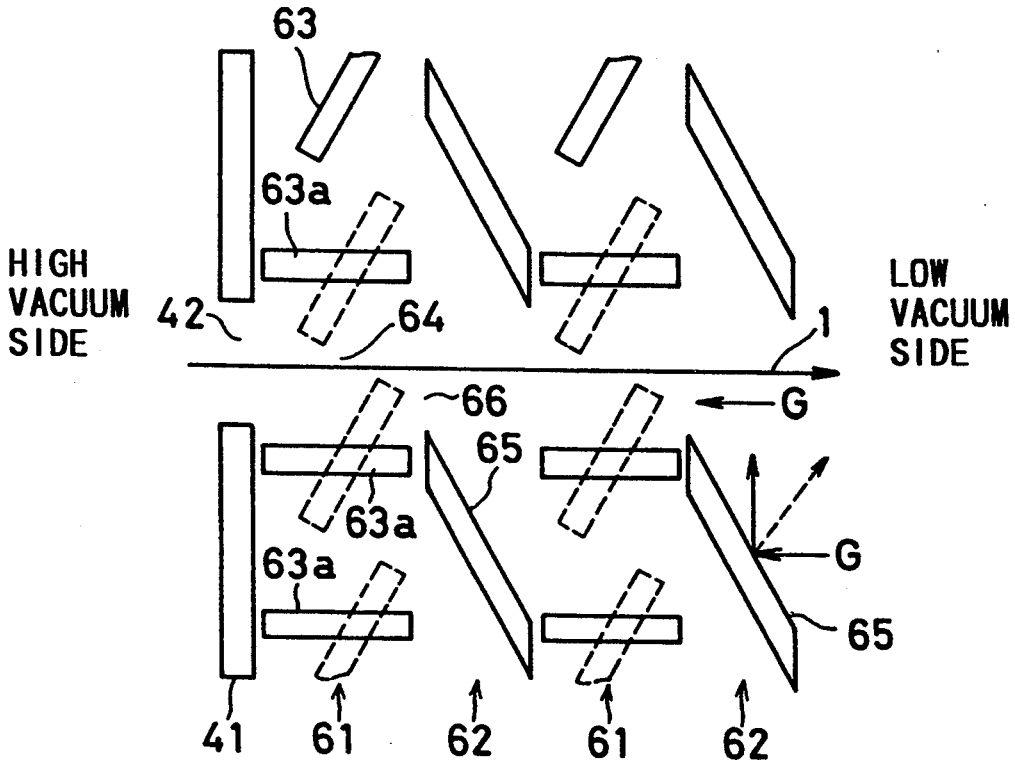
FIG. 5 is an enlarged schematic diagram of a cross section of the stator and rotor of a multistage axial-flow arrangement of FIG. 1 taken along section line V—V.

As shown in FIG. 5, when the opening 64 is aligned with the gap 66 between the blades 65 of the rotor 62 shown in FIG. 4A, the radiation beam 1 passes through the multistage axial-flow arrangement 6. It is possible to rotate the blades 63*a* by a mechanical linkage, or by changing the temperature of a shape memory alloy whose tilt angle depends on temperature.

In FIG. 5, the gas G remaining in the low vacuum side is attracted to the high vacuum side through the openings 66 and 64 of the stator 61 and rotor 62, respectively. However, because the blade 65 moves upward at a high speed as the rotor 62 rotates as shown by the arrow in FIG. 5, the residual gas G after colliding with the blade 65 is returned to the low vacuum side in the direction shown by the broken-line. Thus, the gas does not flow into the high vacuum side. Even if some residual gas G flows into the high vacuum side through the gap 66 between the blades 65, it is returned to the low vacuum side by the blade 65 of a later stage because a plurality of rotors 62 are repeatedly arranged in the axial direction.

The multistage axial-flow arrangement 6 is able to include many exhaust stages each of which has a stator 61 and rotor 62 in a very small space. Therefore, even if the low vacuum side is at the atmospheric pressure rather than at the vacuum level of $10^{-1}$ to $10^{-2}$ Torr, it is possible to maintain the high vacuum level of the electron storing ring 2 by increasing the number of exhaust stages used.

Because the residual gas moves at speeds up to the speed of sound, it is much slower than a radiation beam which moves at the speed of light. Therefore, even if the rotor 62 rotates fast enough for the blades 65 to stop the movement of the residual gas, the path of the radiation beam is not completely interrupted by the blade 65. Radiation beam 1 is intermittent because it is switched by the blade 65 of the rotor 62. However, in practice, there is no problem because the rotor 62 rotates at high speed.

Figure 6:
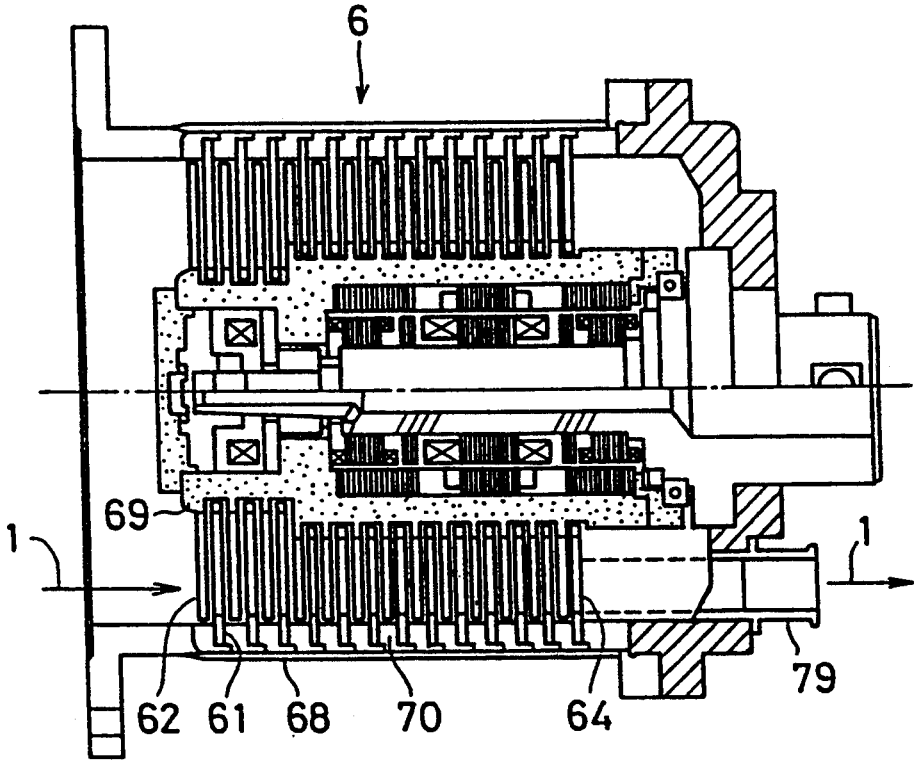
FIG. 6 is a sectional view of the structure of a multistage axial-flow arrangement.

The multistage axial-flow arrangement 6 used in a synchrotron radiation beam generator in accordance with the present invention has substantially the same structure as a vacuum pump, as shown in FIG. 6, in that a plurality of stators 61 and a plurality of rotors 62 are alternately arranged in the axial direction. The periphery of each stator 61 is secured by the enclosure 68 and spacer 70, and the center of each rotor 62 is secured to the rotor shaft 69. The radiation beam outlet 79 is formed on a part of the enclosure 68 of the multistage axial-flow arrangement 6 and blades **63*a* forming the opening 64 in the stators 61 are arranged in alignment with the radiation beam outlet 79. Therefore, the radiation beam 1 coming into the multistage axial-flow arrangement 6 from the high vacuum side passes through the gap 66 between the blades 65 of the rotors 62 and the opening 64 in the stators 61 and is emitted from the radiation beam outlet 79**.

Figure 7:
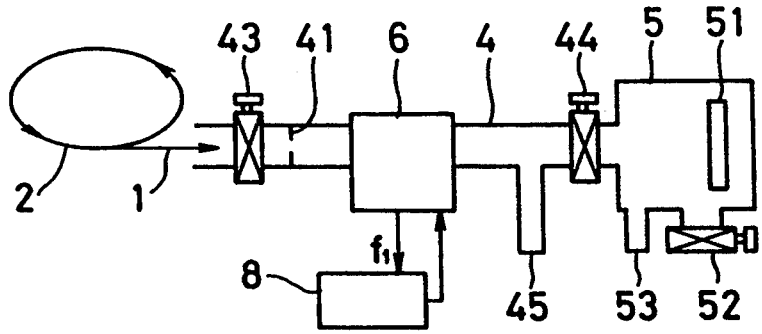
FIG. 7 is a schematic diagram showing another embodiment of a synchrotron radiation beam generator in accordance with the present invention.

In FIG. 7, the electron storing ring 2 of an embodiment of the present invention is connected with the operation chamber 5, in which the radiation target 51 is set, through the beam duct 4. The gate valve 43 and aperture 41 are located the high vacuum side (near the electron storing ring 2) of the beam duct 4 and the gate valve 44 and exhaust duct 45 are located on the low vacuum side. The vacuum level of the operation chamber 5 is adjusted to $10^{-1}$ to $10^{-2}$ Torr by the gate valve 52 and exhaust duct 53.

In the above radiation generator, the inside of the electron storing ring 2 connected to the beam duct 4 is brought to a predetermined high vacuum level by adjusting the gate valves 43, 44 and exhaust duct 45 and rotating the multistage axial-flow arrangement 6 interposed in the beam duct 4. The multistage axial-flow arrangement 6 is driven by high-frequency signals output by the controller 8. When there is a difference between the feedback signal fl and a control signal, the rotation speed of the multistage axial-flow arrangement 6 is corrected in order to eliminate the difference.

In this embodiment, the vacuum level of the electron storing ring 2 is prevented from lowering because residual gas is returned through the opening 64 a radiation beam can efficiently be extracted from the high vacuum atmosphere by tilting the direction of blades **63*a* of the fixed impeller 61 so that it coincides with the axial direction to form the opening 64 only when a radiation beam passes through the multistage axial-flow arrangement 6 and greatly tilting these blades 63*a* from the axial direction to close the opening 64** when the radiation beam does not pass through the arrangement.

Figure 8A:
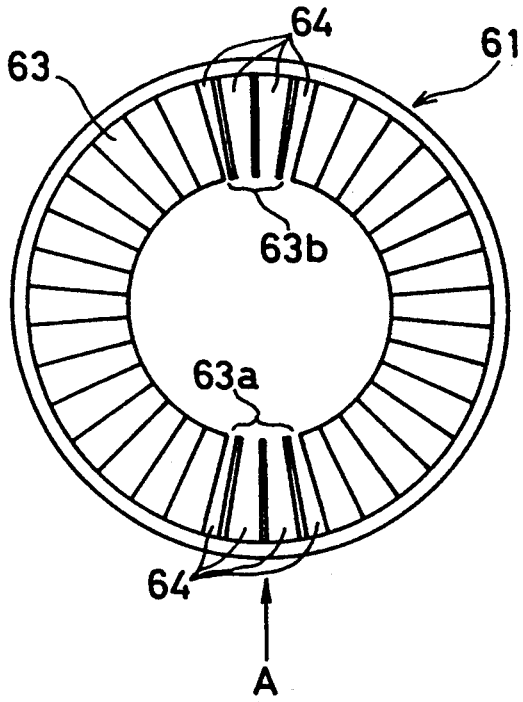
FIG. 8A is an axial view of a stator for another embodiment of the present invention.
Figure 8B:
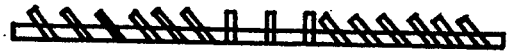
FIG. 8B is a schematic side view of a stator showing another embodiment of the present invention.
Figure 9:
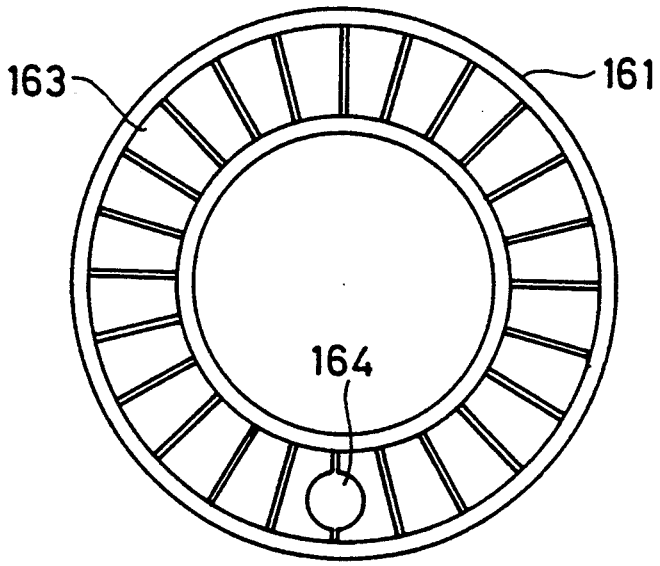
FIG. 9 PRIOR ART
FIG. 9 is an axial view of the stator of the multistage axial-flow arrangement of a conventional synchrotron radiation beam generator.
Figure 10:
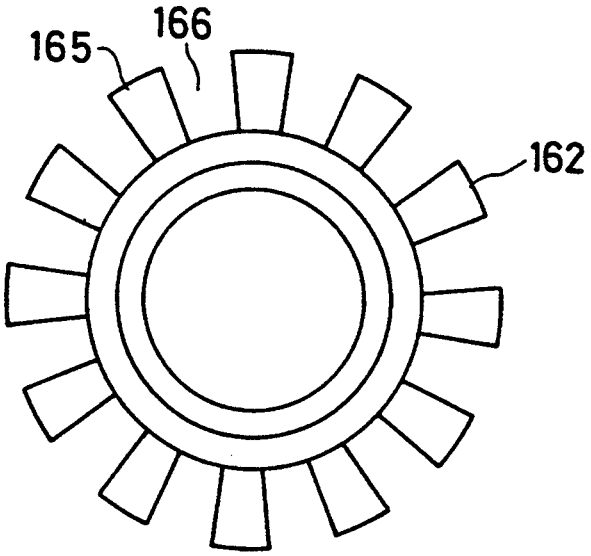
FIG. 10 PRIOR ART
FIG. 10 is a top view of the rotor of the multistage axial-flow arrangement of a conventional synchrotron radiation beam generator.

FIGS. 8A and 8B shows another embodiment of the present invention. In this embodiment, blades **63*a* and 63*b* capable of varying their tilt angle are set at the top and bottom so that openings 64** are formed at two places. This embodiment makes it possible to simultaneously provide beams to two radiation targets.

As described above, the present invention makes it possible to efficiently extract a radiation beam from a high vacuum atmosphere by closing an opening in the stator when no radiation beam passes through a multistage axial-flow arrangement and preventing the vacuum level from lowering due to return of residual gas through the opening.

What is claimed is:

1. A synchrotron radiation beam generator comprising:

a synchroton having an electron storing ring for accelerating electrons at a predetermined rotating speed;

a beam duct coupled to the electron storing ring for extracting a synchrotron radiatin beam out of the electron storing ring; and a multistage axial-flow arrangement having a plurality of stators with blades and a plurality of rotors with blades, the multistage axial-flow arrangement being disposed in the beam duct for maintaining the electron storing ring side at a high vacuum level;

wherein the plurality of stators have fixed tilt angle blades and variable tilt angle blades.

2. A synchrotron radiation beam generator according to claim 1; wherein the variable tilt angle blades are disposed to undergo angular turning displacement to form an opening to output the synchrotron radiation beam.

3. A synchrotron radiation beam generator according to claim 1; wherein the tilt angle of the variable tilt angle blades is controlled by a mechancial linkage.

4. A synchrotron radiation beam generator according to claim 1; wherein the variable tilt angle blades are made of a shape-memory alloy.

5. Apparatus for extracting a radiation beam from a radiation beam generator, comprising: a beam duct connected in use to a radiation beam generator for extracting a radiation beam from the radiation beam generator and transmitting the radiation beam through the beam duct; and a multistage axial-flow arrangement disposed within the beam duct for controlling transmission of the radiation beam through the beam duct while maintaining the portion of the beam duct upstream of the multistage axial-flow arrangement at a higher vacuum level than the beam duct portion downstream thereof, the multistage axial-flow arrangement comprising a plurality of stators with blades coacting with a plurality of rotors with blades for maintaining the higher vacuum level at the upstream portion of the beam duct, wherein the blades of the stators are disposed at respective tilt angles, and wherein at least one blade of each stator has a variable tilt angle.

6. Apparatus according to claim 5; wherein the stator blades having a variable tilt angle are disposed to form a radiation beam path when the tilt angles thereof are set to an open state.

7. Apparatus according to claim 6; including means for varying the tilt angle of the stator blades having a variable tilt angle.

8. Apparatus according to claim 7; wherein the means for varying the tilt angle comprises a mechanical linkage.

9. Apparatus according to claim 6; wherein the stator blades having a variable tilt angle are made of a shape-memory alloy.

10. Apparatus according to claim 5; including means for varying the tilt angle of the stator blades having a variable tilt angle.

11. Apparatus according to claim 9; including means for varying the tilt angle of the stator blades having a variable tilt angle.

* * * * *